US010662710B2

(12) United States Patent
Rodriguez

(10) Patent No.: US 10,662,710 B2
(45) Date of Patent: May 26, 2020

(54) WELLBORE INTERACTIVE-DEFLECTION MECHANISM

(71) Applicant: Halliburton Energy Services, Inc., Houston, TX (US)

(72) Inventor: Franklin Charles Rodriguez, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 281 days.

(21) Appl. No.: 15/528,191

(22) PCT Filed: Dec. 15, 2015

(86) PCT No.: PCT/US2015/065710
§ 371 (c)(1),
(2) Date: May 19, 2017

(87) PCT Pub. No.: WO2017/105402
PCT Pub. Date: Jun. 22, 2017

(65) Prior Publication Data

US 2017/0362896 A1 Dec. 21, 2017

(51) Int. Cl.
*E21B 7/08* (2006.01)
*E21B 29/06* (2006.01)
(Continued)

(52) U.S. Cl.
CPC ..... *E21B 7/061* (2013.01); *E21B 29/06* (2013.01); *E21B 41/0035* (2013.01)

(58) Field of Classification Search
CPC ... E21B 7/061; E21B 41/0035; E21B 41/0042
See application file for complete search history.

(56) References Cited

U.S. PATENT DOCUMENTS 2,999,543 A * 9/1961 Myers ..... E21B 43/10 166/129
3,171,483 A * 3/1965 Fredd ..... E21B 43/14 166/114

(Continued)

OTHER PUBLICATIONS

Halliburton Energy Services, Inc , "Multilateral Solutions", available at http://www.halliburton.com/public/cps/contents/Books_and_Catalogs/web/CPSCatalog/02_Multilateral_Solutions.pdf, as early as May 13, 2015, 6 pages.

(Continued)

*Primary Examiner* — Robert E Fuller
(74) *Attorney, Agent, or Firm* — Kilpatrick Townsend & Stockton LLP

(57) ABSTRACT

A deflection mechanism may include a first incline and a second incline for interacting with legs of a junction assembly to selectively deflect each of the legs in a desired direction in a multilateral wellbore system. The deflection mechanism may include a window assembly for a main borehole of the wellbore and having a selective-deflection profile positioned proximate to an entrance into a lateral borehole extending from the main borehole. One leg of the junction assembly may include a surface profiled corresponding to an angle of the first incline to deflect the leg toward the lateral borehole. Another leg of the junction assembly may include a surface profiled corresponding to an angle of the second incline to deflect the leg toward a whipstock assembly positioned internal to the window assembly.

17 Claims, 10 Drawing Sheets

(51) Int. Cl.
*E21B 7/06* (2006.01)
*E21B 41/00* (2006.01)

(56) References Cited

U.S. PATENT DOCUMENTS

| | | | | |
|---|---|---|---|---|
| 4,508,166 | A * | 4/1985 | Becker | E21B 23/03 166/117.5 |
| 6,089,320 | A | 7/2000 | LaGrange | |
| 6,158,513 | A * | 12/2000 | Nistor | E21B 23/002 166/117.6 |
| 6,209,644 | B1 | 4/2001 | Brunet | |
| 6,311,776 | B1 * | 11/2001 | Pringle | E21B 23/002 166/117.6 |
| 6,332,498 | B1 | 12/2001 | George et al. | |
| 6,419,026 | B1 | 7/2002 | Mackenzie et al. | |
| 6,561,279 | B2 | 5/2003 | Mackenzie et al. | |
| 6,619,400 | B2 | 9/2003 | Brunet | |
| 6,679,329 | B2 | 1/2004 | Murray et al. | |
| 6,732,801 | B2 * | 5/2004 | Ohmer | E21B 7/061 166/117.6 |
| 6,848,504 | B2 | 2/2005 | Brunet et al. | |
| 6,907,930 | B2 | 6/2005 | Cavender et al. | |
| 7,011,151 | B2 | 3/2006 | McGarian et al. | |
| 7,231,980 | B2 | 6/2007 | Murray et al. | |
| 7,497,264 | B2 | 3/2009 | Moody et al. | |
| 7,537,055 | B2 | 5/2009 | Head et al. | |
| 8,376,066 | B2 | 2/2013 | Steele et al. | |
| 8,695,694 | B1 * | 4/2014 | Lajesic | E21B 23/002 166/117.6 |
| 8,701,770 | B2 * | 4/2014 | Schultz | E21B 36/02 166/272.7 |
| 8,826,991 | B2 | 9/2014 | Steele et al. | |
| 9,284,802 | B2 * | 3/2016 | Stokes | E21B 41/0035 |
| 10,012,045 | B2 * | 7/2018 | Lajesic | E21B 17/18 |
| 2003/0042024 | A1 | 3/2003 | Freeman et al. | |
| 2005/0145392 | A1 | 7/2005 | Haugen et al. | |
| 2006/0266531 | A1 | 11/2006 | Hepburn et al. | |
| 2012/0305266 | A1 | 12/2012 | Steele et al. | |
| 2015/0068756 | A1 | 3/2015 | Pendleton | |
| 2015/0275645 | A1 * | 10/2015 | Gill | E21B 41/0042 166/303 |

OTHER PUBLICATIONS

International Patent Application No. PCT/US2015/065710, "International Search Report and Written Opinion", dated Sep. 13, 2016, 18 pages.

* cited by examiner

WELLBORE INTERACTIVE-DEFLECTION MECHANISM

CROSS-REFERENCE TO RELATED APPLICATIONS

This is a U.S. national phase under 35 U.S.C. 371 of International Patent Application No. PCT/US2015/065710 titled "Wellbore Interactive-Deflection Mechanism" and filed Dec. 15, 2015, the entirety of which is incorporated herein by reference.

TECHNICAL FIELD

The present disclosure relates generally to multilateral wellbore systems and, more particularly, to an interactive-deflection mechanism for use in a multilateral wellbore.

BACKGROUND

A multilateral wellbore may include a main borehole and one or more lateral boreholes extending from the main borehole. A multilateral wellbore may be completed, particularly at the junction between the main borehole and a lateral borehole, to avoid damage to the wellbore in unconsolidated or weakly consolidated formations. For example, if not deliberately reinforced, the junction between the main borehole and the lateral borehole may be one of the weakest points in the wellbore and may subject the wellbore to collapse. Further, isolation between the main borehole and the lateral boreholes may be used to allow the multilateral wellbore as a whole to withstand hydraulic pressure during the production phase of a wellbore operation. Hydraulic sealing may be particularly important at the junction to prevent pressure loss or fluid migration in the wellbore during wellbore operations. A junction assembly may be positioned in the wellbore to provide simultaneous connectivity to the main borehole and the lateral borehole while maintaining isolation between the main borehole and the lateral borehole. But, completing the wellbore with the junction assembly may require a number of downhole trips into the wellbore, resulting in additional time and cost for wellbore operations.

DETAILED DESCRIPTION

Figure 1:
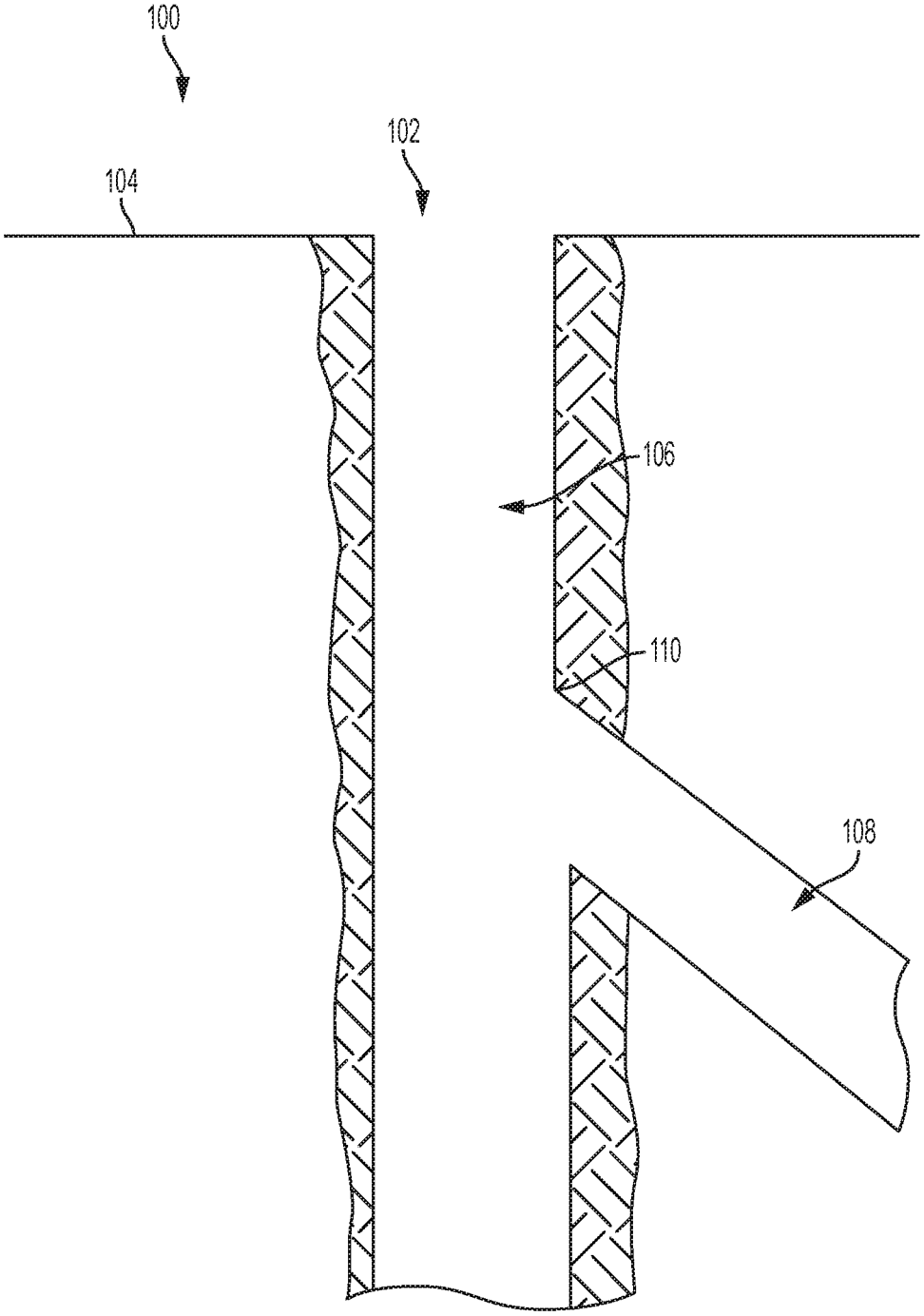
FIG. 1 is a cross-sectional schematic diagram depicting an example of a wellbore environment including a wellbore having a main borehole and a lateral borehole according to one aspect of the present disclosure.

Certain aspects and examples of the present disclosure relate to a wellbore interactive-deflection mechanism including a window sleeve having a profile for deflecting (i) a lateral leg of a junction assembly into a lateral borehole of a wellbore and (ii) a mainbore leg of the junction assembly into a through-bore of a whipstock assembly positioned in window assembly in a main borehole of the wellbore. The selective-deflection profile may include two inclines positioned on the window sleeve to interact, or otherwise engage, the legs of the junction assembly. In some aspects, one of the two inclines may correspond to a surface of the lateral leg to deflect the lateral leg toward the lateral borehole. The other incline may correspond to a surface of the mainbore leg to deflect the mainbore leg toward the through-bore of the whipstock assembly. In some aspects, the window sleeve may be positioned and cemented in the main borehole of the wellbore proximate to an intended location of the lateral borehole extending from the main borehole. The whipstock assembly may be positioned in the through-bore of the window sleeve to provide support for the window sleeve and isolation of the main borehole from the lateral borehole.

A whipstock device of the whipstock assembly may include an angled surface from which a milling tool may be deflected to create a window, or opening, in the window sleeve. The angled surface may also be used by a drilling tool to drill the lateral borehole in the wellbore through the window in the window sleeve. The whipstock device may be retrievable from the whipstock assembly prior to installation of the junction assembly. The junction assembly may include two tubing strings (which may be referred to as "legs"). In some aspects, installing the junction assembly in the wellbore may complete the wellbore. In additional and alternative aspects, the junction assembly may include isolation devices such that the wellbore may be classified as a Technology Advancement of MultiLaterals ("TAML") level 5 multilateral junction system supporting a junction between the main and lateral boreholes and having isolation between the main and lateral boreholes.

Using an interactive-deflection mechanism according to some aspects may allow the junction assembly to be efficiently installed in a multilateral wellbore. In some aspects, using an interactive-deflection mechanism may obviate a need to install a separate deflector assembly to deflect one leg of the junction assembly into the lateral borehole, resulting in both cost-savings and time-savings. For example, the interactive-deflection mechanism may save time necessary to install the separate deflector assembly in the main borehole. In some aspects, installing a separate deflector assembly may require at least twelve hours of operational time and associated labor costs. Thus, using the interactive-deflection mechanism may result in a reduction of the overall time, and associated costs, to install the junction assembly downhole in the wellbore by over half a day.

The terms "inner," "outer," "internal," "external," "interior," and "exterior," as used in the present disclosure may refer to a radial orientation toward or away from the center of the wellbore unless otherwise stated. The terms "uphole" and "downhole," as used in the present disclosure may refer to an axial orientation toward or away from the surface unless otherwise stated or described.

Various aspects of the present disclosure may be implemented in various environments. For example, FIG. 1 is a cross-sectional schematic diagram depicting an example of a wellbore environment 100 including a wellbore having a main borehole and a lateral borehole according to one aspect of the present disclosure. In some aspects, the wellbore environment 100 may include an interactive-deflection mechanism. The wellbore environment 100 includes a wellbore 102 formed in a surface 104 of the earth. The wellbore 102 may be constructed in any suitable manner, such as by use of a drilling assembly having a drill bit for creating the wellbore 102. In some aspects, the wellbore environment 100 may be an off-shore environment. For example, the wellbore 102 may extend through a sea or other body of water and the surface 104 may be a floor of the sea. In alternative aspects, the wellbore environment 100 may be an on-shore environment. The wellbore 102 may be a multilateral wellbore including a main borehole 106 and a lateral borehole 108 extending from the main borehole 106 at a junction 110. In some aspects, additional boreholes may extend from the main borehole 106 or the lateral borehole 108. Although FIG. 1 shows the main borehole 106 in a vertical orientation, the main borehole 106 may include any orientation, including a horizontal orientation without departing from the scope of the present disclosure. Similarly, the angle at which the lateral borehole 108 extends from the main borehole 106 may be any angle without departing from the scope of the present disclosure.

Figure 2:
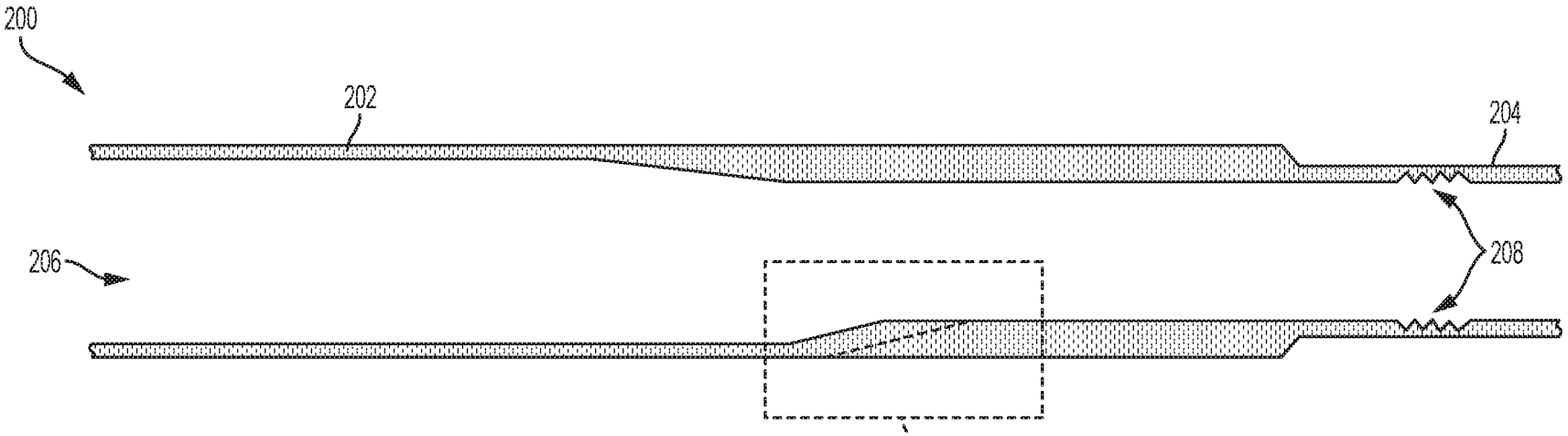
FIG. 2 is a cross-sectional view of a window sleeve including a selective-deflection profile according to one aspect of the present disclosure.
Figure 3:
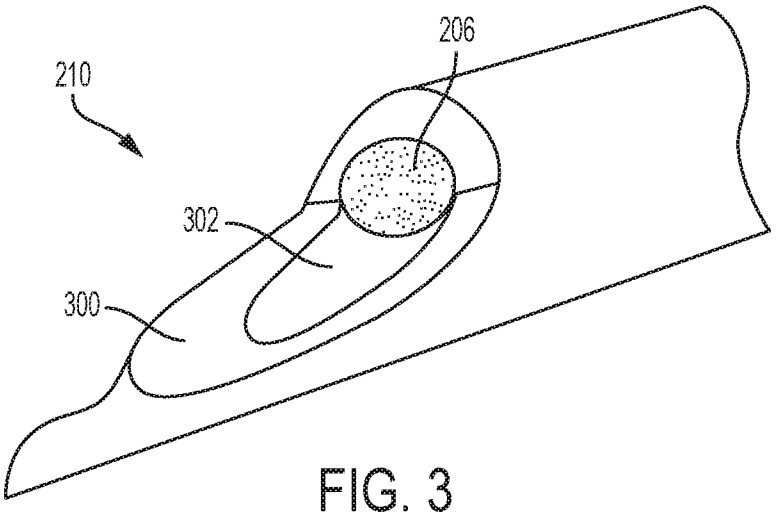
FIG. 3 is a perspective view of the selective-deflection profile of the window sleeve of FIG. 2 according to one aspect of the present disclosure.

FIG. 2 is a cross-sectional view of a window sleeve 200 including a selective-deflection profile according to one aspect of the present disclosure. FIG. 3 is a perspective view of the selective-deflection profile of the window sleeve 200 of FIG. 2 according to one aspect of the present disclosure. In some aspects, the window sleeve 200 may include an aluminum-wrapped window pre-milled in a casing string of the main borehole 106. In other aspects, the window sleeve 200 may include a tube that may be positioned in the main borehole 106 of the wellbore 102. A portion of the tube may be positioned against a casing of the main borehole 106. The tube may be made of aluminum and include an aluminum wrap. Although the window sleeve 200 is described as including an aluminum material, the window sleeve 200 may include any materials suitable to allow an opening to be created in the window sleeve 200 using a milling tool. The window sleeve 200 may include at least two portions 202, 204. In some aspects, the window sleeve 200 may be positioned in the wellbore 102 such that the portion 202 is uphole of the portion 204. In some aspects, the portion 202 may include an outer diameter greater than an outer diameter of the portion 204. In some aspects, the portion 202 may include an inner diameter greater than an inner diameter of the portion 204. The window sleeve 200 may include a through-bore 206 expanding the length of the window sleeve 200 internal to the portions 202, 204. The window sleeve may also include a latch mechanism 208. In some aspects, the latch mechanism 208 may be positioned in the through-bore 206 on an internal surface of the portion 204 of the window sleeve 200. In some aspects, the latch mechanism 208 may include grooves, ridges, indentations, or other non-linear surface in the portion 204. In additional and alternative aspects, the surface of the latch mechanism 208 may correspond to an external surface of a component positioned in the through-bore (e.g., a whipstock assembly) to couple the component to the window sleeve 200. For example, the latch mechanism 208 may include grooves corresponding to indentations on the component to latch or otherwise couple the component to the window sleeve 200.

The window sleeve 200 may also include a selective-deflection profile 210. In some aspects, the selective-deflection profile 210 may be positioned on an internal surface of the window sleeve 200 as shown in FIG. 2. The selective-deflection profile 210 may include a first incline 300 and a second incline 302 as shown in FIG. 3. In some aspects, the first incline 300 may include an internal surface of the window sleeve 200 having an angle to cause a leg of a junction assembly to be deflected toward an opposing surface of the window sleeve 200. The second incline 302 may include an internal surface of the window sleeve 200 having an angle to cause another leg of the junction assembly to be deflected further into the through-bore 206 or into a component positioned in the through-bore 206. In some aspects, the angle of the first incline 300 may be greater than the angle of the second incline 302. For example, the first incline 300 may be angled at approximately 8 degrees from the internal surface of the window sleeve 200 and the second incline 302 may be angled at approximately 4 degrees from the internal surface of the window sleeve 200. In some aspects, the second incline 302 may be milled or otherwise positioned within the first incline 300 such that the second incline 302 creates a partial groove in the first incline 300. In additional aspects, the radial width of the first incline 300 may be greater than the radial width of the second incline 302 as shown in FIG. 3.

In some aspects, the window sleeve 200 may be positioned in the main borehole 106 of FIG. 1 such that the selective-deflection profile 210 is proximate to a location or intended location of the junction 110 or lateral borehole 108. For example, the selective-deflection profile 210 may be positioned on a portion of the window sleeve 200 opposite the portion of the window sleeve 200 positioned adjacent to the location or intended location of the junction 110. In this position, the first incline 300 of the selective-deflection profile 210 may, subsequent to drilling the lateral borehole 108, deflect a leg of the junction assembly into the lateral borehole 108.

Figure 4:
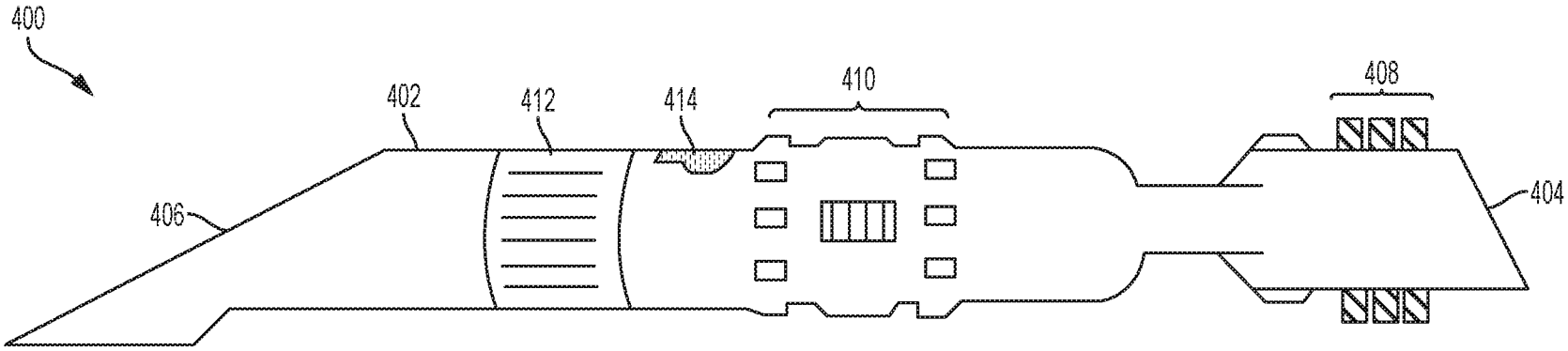
FIG. 4 is a perspective side view of a whipstock assembly that may be used to complete the wellbore of FIG. 1 according to one aspect of the present disclosure.
Figure 5:
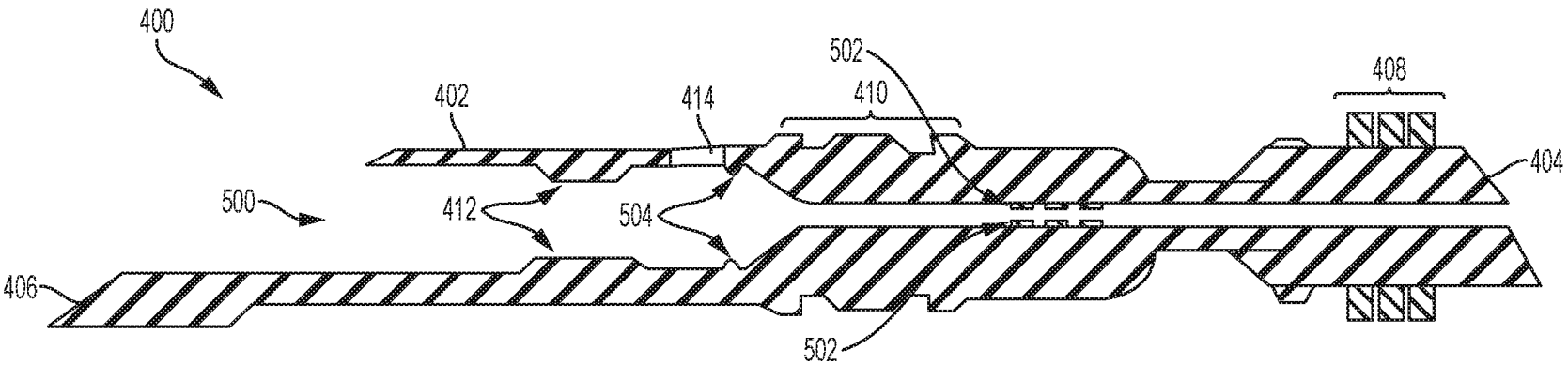
FIG. 5 is a cross-sectional view of the whipstock assembly of FIG. 4 according to one aspect of the present disclosure.

FIG. 4 is a perspective side view of a whipstock assembly that may be used to complete the wellbore of FIG. 1 according to one aspect of the present disclosure. FIG. 5 is a cross-sectional view of the whipstock assembly of FIG. 4 according to one aspect of the present disclosure. The whipstock assembly 400 may include a whipstock device 402 and a stinger 404. The whipstock device 402 may include an angled surface 406 for deflecting mills, drills, or other cutting tools. The whipstock assembly 400 may be positioned in the main borehole 106 at an intended location of the lateral borehole 108 to aid in the drilling of the lateral borehole 108. In some aspects, the whipstock assembly 400 may include an outer diameter sized to allow the whipstock assembly 400 to be positioned in the through-bore 206 of the window sleeve 200 shown in FIG. 3. In some aspects, the whipstock assembly 400 may be oriented in the main borehole 106 such that the whipstock device 402 is positioned uphole of the stinger 404. In additional aspects, the whipstock assembly 400 may be oriented in the through-bore 206 such that the angled surface 406 of the whipstock device 402 is positioned adjacent to the selective-deflection profile 210 of the window sleeve 200. In some aspects, the window sleeve 200 and the whipstock assembly 400 may include mechanisms or components to aid in the alignment and orientation of the whipstock assembly 400 in the through-bore 206. The stinger 404 of the whipstock assembly 400 may include one or more isolation devices 408. The isolation devices 408 may be positioned on an external surface of the stinger 404. Non-limiting examples of isolation devices 408 may include seals, packers, plugs, bridge plugs, and wiper plugs. The one or more isolation devices 408 may be sized and positioned internal to the window sleeve 200 of FIG. 2 to create a seal that may isolate a portion of the through-bore 206 downhole of the isolation devices 408 from a portion of the through-bore 206 uphole of the isolation devices 408.

The whipstock assembly 400 may also include a latch mechanism 410. The latch mechanism 410 may be positioned on an external surface of the whipstock assembly 400 axially between the whipstock device 402 and the stinger 404. In some aspects, the latch mechanism 410 may include grooves, ridges, indentations, or other non-linear surface. In additional and alternative aspects, the latch mechanism 410 may correspond to the latch mechanism 208 of the window sleeve 200 shown in FIG. 2. The latch mechanism 410 may be aligned with the latch mechanism 208 of the window sleeve 200 to couple the whipstock assembly 400 to the window sleeve 200. In some aspects, the latch mechanisms 208, 410 may couple the window sleeve 200 and the whipstock assembly 400 such that the whipstock assembly 400 is axially or radially fixed in the through-bore.

The whipstock assembly 400 may include a detaching mechanism 412 and a retrieving mechanism 414. In some aspects, the detaching mechanism 412 may be positionable adjacent to the whipstock device 402. In some aspects, the detaching mechanism may be positionable downhole of the whipstock device 402 and uphole of the retrieving mechanism 414. The detaching mechanism 412 may allow the whipstock device 402 to be detached from the whipstock assembly 400 and retrieved from the main borehole 106. In some aspects, the detaching mechanism 412 may include a material (e.g., perforated metal) that is breakable in response to an application of an uphole force. In other aspects, the detaching mechanism 412 may include one or more interconnecting or coupling devices (e.g., collets, mandrels, clamps, plugs, etc.) configured to decouple the whipstock device 402 from the whipstock assembly 400 in response to a force or other actuation means. The detaching mechanism 412 may also include a hole, ridge, or other engaging means to support retrieval of the whipstock device 402 from the main borehole 106. In some aspects, the retrieving mechanism 414 may be positioned downhole of the detaching mechanism 412 on the whipstock assembly 400. The retrieving mechanism may include one or more holes, ridges, or other engaging means to support retrieval of the whipstock assembly 400 from the through-bore 206 of the window sleeve 200. In some aspects, the whipstock assembly 400 may be configured to remain in the through-bore 206 subsequent to retrieving the whipstock device 402. But, the retrieving mechanism 414 may allow a retrieval tool to engage the whipstock assembly 400 in a manner that decouples the latch mechanism 410 from the latch mechanism 208 of the window sleeve 200 to pull the whipstock assembly 400 uphole and out of the main borehole 106.

The whipstock assembly 400 may also include a through-bore 500 as shown in FIG. 5. The through-bore 500 may extend the length of the whipstock assembly from the whipstock device 402 to the stinger 404. In some aspects, the through-bore 500 may be sized to allow a leg of the junction assembly to be received in the through-bore 500. One or more additional isolation devices 502 may be positioned on an internal surface of the whipstock assembly 400 in the through-bore 500 to engage the leg of the junction assembly. A ring 504 may also be positioned in the through-bore 500 to engage the leg of the junction assembly. In some aspects, the ring 504 may be a shearable ring configured to shear in response to a force applied to the ring 504 by the leg of the junction assembly. In additional aspects, the ring 504 may transmit a signal uphole via the junction assembly indicating that the leg is properly positioned in the through-bore 500 of the whipstock assembly 400. Upon engagement with the leg of the junction assembly, the isolation devices 502, may isolate a portion of the through-bore 500 downhole of the isolation devices 502 from a portion of the through-bore 500 uphole of the isolation devices 502. The isolation devices 408, 502, together, may isolate any fluid or pressure in the main borehole 106 downhole of the whipstock assembly 400 from any fluid or pressure in the lateral borehole 108 and the main borehole 106 uphole of the whipstock assembly 400.

Figure 6:
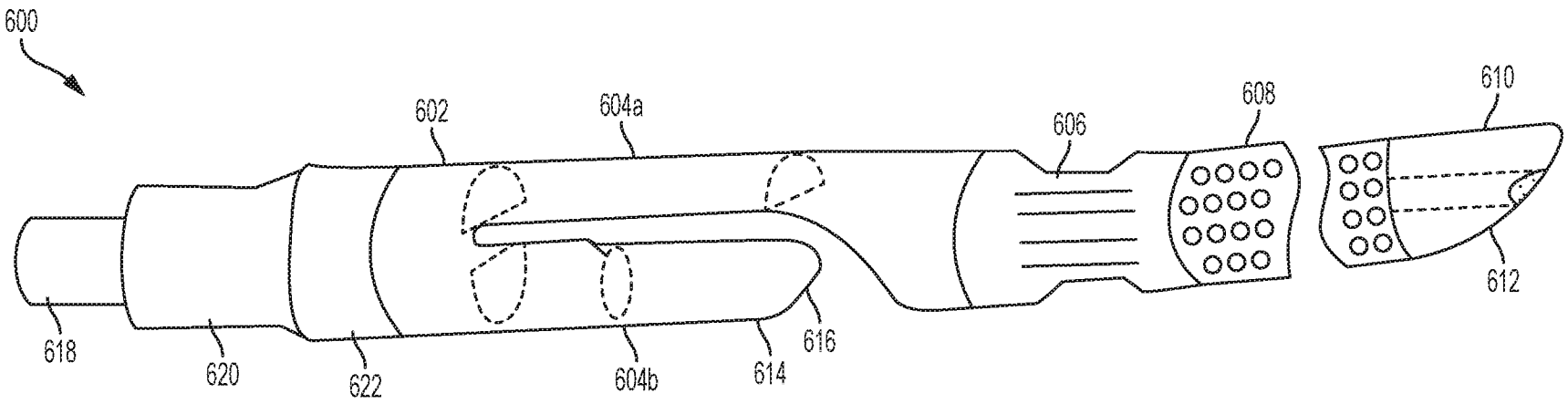
FIG. 6 is a cross-sectional view of a junction assembly including legs having end surfaces profiled to correspond with the selective-deflection profile of the window sleeve of FIG. 2 according to one aspect of the present disclosure.

FIG. 6 is a cross-sectional view of a junction assembly including legs having end surfaces profiled to correspond with the selective-deflection profile of the window sleeve 200 of FIG. 2 according to one aspect of the present disclosure. The junction assembly 600 may include a wye block tube 602. The wye block tube 602 may include tubing string having a single port on one side of the wye block tube 602 and two ports on the opposing side of the wye block tube 602. Each of the two ports may be connected to a tubing string such that the tubing strings form legs 604*a*, 604*b* extending from the ports of the wye block tube 602. In some aspects, the junction assembly 600 may be positioned in the wellbore 102 such that the wye block tube 602 is positioned uphole of the legs 604*a*, 604*b*. In some aspects, the wye block tube 602 may include a Y-shaped cross-section. In additional and alternative aspects, the legs 604*a*, 604*b* may include a D-shaped cross-section. The legs 604*a*, 604*b* may be flexible tubes allowing them to be maneuvered within the wellbore 102. In some aspects, a portion of the leg 604*a* may be positionable in the lateral borehole 108 while a portion of the leg 604*b* remains in the main borehole 106. In some aspects, the wye block tube 602 and the legs 604*a*, 604*b* may have hollow interiors. The hollow interiors of the wye block tube 602 and the legs 604*a*, 604*b* may allow fluid or material to pass downhole from the wye block tube 602 into the legs 604*a*, 604*b* or to pass uphole from one of the legs 604*a*, 604*b* into the wye block tube 602.

A safety sub 606, one or more sand screen devices 608, and an end portion 610 may be included on, or otherwise connected to, the leg 604*a*. In some aspects, the safety sub 606, the sand screen devices 608, and the end portion 610 may be positioned in the lateral borehole 108 of the wellbore 102. In some aspects, the safety sub 606 may be positioned adjacent to the sand screen devices 608 and uphole of the sand screen devices 608. In some aspects, the safety sub 606 may be fractured or otherwise released from the leg 604*a* to allow the leg 604*a* to be removed from the lateral borehole 108 in the event that the sand screen devices 608 become stuck in the lateral borehole 108. The sand screen devices 608 may include any suitable filtering devices used to separate sand particles or other particulate materials of a predetermined size from fluids or other materials (e.g., drilling equipment) in the wellbore 102. A non-limiting example of a sand screen device may include screen wire wrapped around a tube. In some aspects, the sand screen devices 608 may be positioned in the lateral borehole 108 along a diameter of the lateral borehole 108 to prevent sand from entering the lateral borehole 108. A production of oil, natural gases, or other desired fluid may filter through the sand and the sand screen devices 608 and flow uphole through the leg 604*a*.

The end portion 610 may be positioned at a downhole end of the junction assembly 600 extending from the leg 604*a*. The end portion may include a surface 612 profiled to have a convex shape as shown in FIG. 6. The convex shape of the surface 612 may include a portion of the surface 612 that extends further downhole than other portions of the surface 612. In some aspects, a slope of the surface 612 may resemble a shoe or dolphin nose. In some aspects, the surface 612 may correspond to an angle of the first incline 300 of the selective-deflection profile 210 shown in FIG. 3. In this manner, the end portion 610 may interact, or otherwise engage with the selective-deflection profile 210 to cause the leg 604*a* to be deflected by the first incline 300 toward the lateral borehole 108 as the junction assembly 600 is routed downhole in the main borehole 106.

The leg 604*b* may also include an end portion 614. The end portion 614 may be positioned at a downhole end of the leg 604*b*. In some aspects, the end portion 614 may be a stinger for providing a seal in the main borehole 106 of the wellbore 102. The end portion 614 may include a surface 616 profiled to have a convex shape as shown in FIG. 6. In some aspects, the convex shape of the surface 616 may include a portion of the surface 616 that extends further downhole than other portions of the surface 616. In some aspects, a slope of the surface 616 may resemble a shoe or dolphin nose. In additional and alternative aspects, a degree of the slope of the surface 616 may be smaller than a degree of the slope of the surface 612 on the end portion 610. In some aspects, the surface 616 may correspond to an angle of the second incline 302 of the selective-deflection profile 210 shown in FIG. 3. In this manner, the end portion 614 may interact with the selective-deflection profile 210 and be deflected by the second incline 302 into the through-bore 500 of the whipstock assembly 400 positioned in the through-bore 206 of the window sleeve 200.

The junction assembly 600 may also include a logging device 618, a liner hanger 620, and an alignment sub 622. Non-limiting examples of the logging device 618 may include a measurement-while-drilling ("MWD") device or a logging-while-drilling device ("LWD"). In one example, the logging device 618 may be configured to guide the junction assembly 600 downhole in the wellbore 102. In some aspects, the logging device 618 may also be configured to confirm that the alignment of the junction assembly 600 is oriented to allow the end portions 610, 614 to interact with the selective-deflection profile 210 of the window sleeve 200 and be deflected into the lateral borehole 108 and the through-bore 500 of the whipstock assembly 400, respectively. The alignment sub 622 may include a mechanism to align the junction assembly 600 in the wellbore 102. In some aspects, the alignment sub 622 may include an adjustment ring or other alignment tool that may be radially adjusted to align the junction assembly 600 in the wellbore 102. In additional and alternative aspects, the alignment sub 622 may engage an alignment crossover or other alignment tool positioned on the window sleeve 200 uphole of the lateral borehole 108 to align the junction assembly 600 in the wellbore 102. The liner hanger 620 may include a mechanism to anchor the junction assembly in the wellbore 102. In some aspects, the liner hanger 620 includes an expandable tubular body that may axially and radially fix the junction assembly 600 to the casing of the main borehole 106. In some aspects, the logging device 618, the liner hanger 620, and the alignment sub 622 may be positioned uphole of the wye block tube 602 on the junction assembly 600. Although the junction assembly 600 includes all of the components (e.g., alignment sub 622, safety sub 606, etc.), as shown in FIG. 6, components may be removed or additional components may be included in the junction assembly 600 without departing from the scope of the present disclosure. Similarly, components of the junction assembly 600 may be included in various positions on the junction assembly 600 without departing from the scope of the present disclosure.

FIGS. 7 through 15 schematically illustrate the window sleeve 200, the whipstock assembly 400, and the junction assembly 600 positioned the wellbore 102. Viewed together, FIGS. 7 through 15 may represent different states of a process for completing the wellbore 102 using the selective-deflection profile 210 described in FIGS. 2 and 3.

Figure 7:
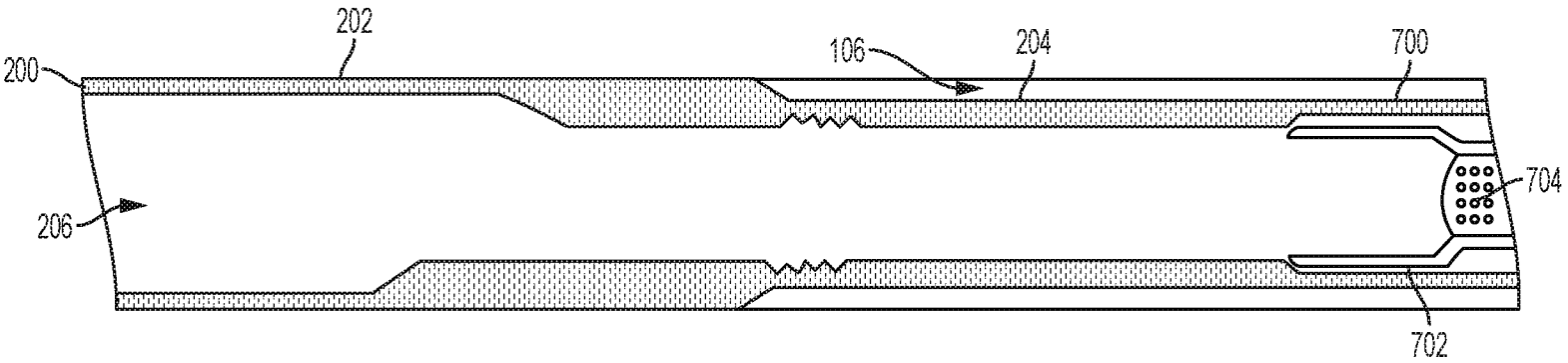
FIG. 7 is a cross-sectional schematic diagram of the main borehole of FIG. 1 depicting an installation of the window sleeve of FIG. 2 according to one aspect of the present disclosure.

FIG. 7 is a cross-sectional schematic diagram of the main borehole 106 of FIG. 1 depicting an installation of the window sleeve 200 of FIG. 2 according to one aspect of the present disclosure. In FIG. 7, the window sleeve 200 is positioned in the main borehole 106 of the wellbore 102. In some aspects, the window sleeve 200 may be pre-milled in a casing string. In other aspects, the window sleeve 200 may be a tube set in the main borehole 106. The window sleeve 200 may include a third portion 700 in addition to the portions 202, 204 of the window sleeve 200. The third portion 700 may be positioned downhole of the portions 202, 204. In some aspects, the third portion may include an inner diameter greater than the inner diameter of the portion 204. A liner hanger 702 may be positioned in the main borehole 106. In some aspects, the liner hanger 702 may be routed through the through-bore 206 of the window sleeve 200 and positioned downhole of the window sleeve 200. A portion of the liner hanger 702 may engage the third portion 700 of the window sleeve 200 to axially fix the liner hanger 702 in the main borehole 106. Sand screen devices 704 may be positioned in the liner hanger 702 to prevent sand from entering the main borehole 106 uphole of the sand screen devices 704.

Figure 8:
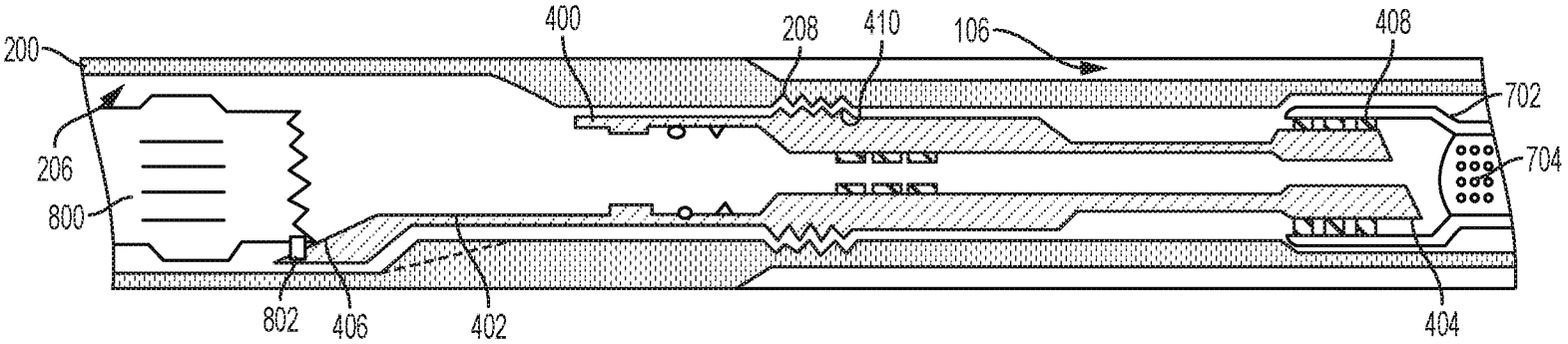
FIG. 8 is a cross-sectional schematic diagram of the main borehole of FIG. 1 depicting an installation of the whipstock assembly of FIG. 4 according to one aspect of the present disclosure.

FIG. 8 is a cross-sectional schematic diagram of the main borehole 106 of FIG. 1 depicting an installation of the whipstock assembly 400 of FIG. 4 according to one aspect of the present disclosure. In FIG. 8, the whipstock assembly 400 may be positioned in the through-bore 206 of the window sleeve 200. In some aspects, the whipstock assembly 400 may be lowered into the main borehole 106 using a milling device 800 that may be coupled to the whipstock assembly 400 by a bolt 802. The bolt 802 may be made of a material rigid enough to support the weight of the whipstock assembly 400 as it is lowered into the main borehole 106. In some aspects, the bolt 802 may be configured to shear or otherwise fractures in response to an application of force by the milling device 800. The whipstock assembly 400 may be positioned in the through-bore 206 of the window sleeve 200 such that the latch mechanism 410 of the whipstock assembly 400 engage the latch mechanism 208 of the window sleeve 200 to fix the whipstock assembly 400 in the through-bore 206. The isolation devices 408 positioned on the stinger 404 of the whipstock assembly 400 may be positioned to engage an inner surface of the liner hanger 702 to provide isolation between the liner hanger and the components uphole of the sand screen devices 704.

Figure 9:
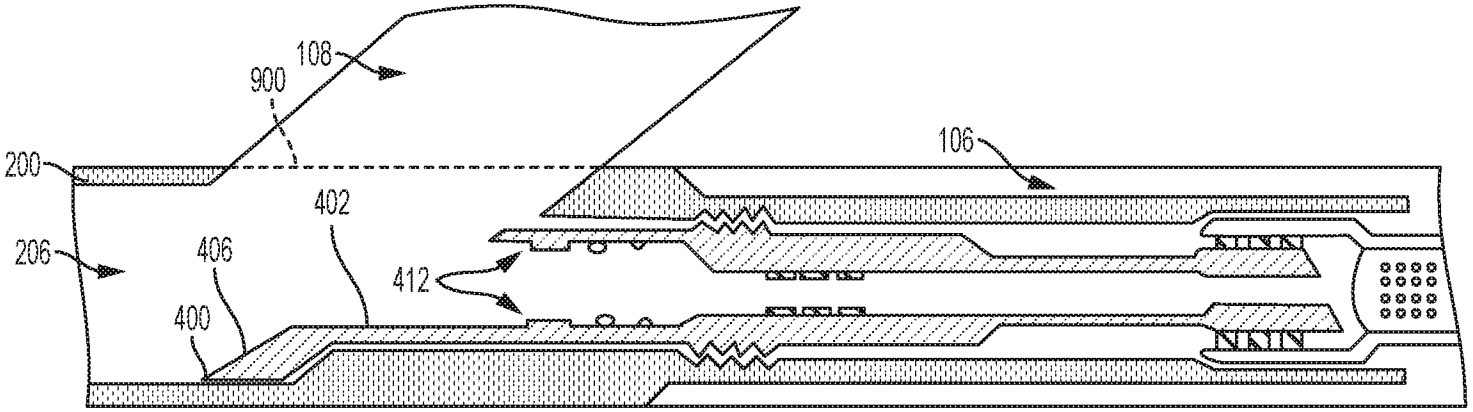
FIG. 9 is a cross-sectional schematic diagram of the wellbore environment of FIG. 1 depicting a window milled in the window sleeve of FIG. 2 to access the lateral borehole according to one aspect of the present disclosure.
Figure 10:
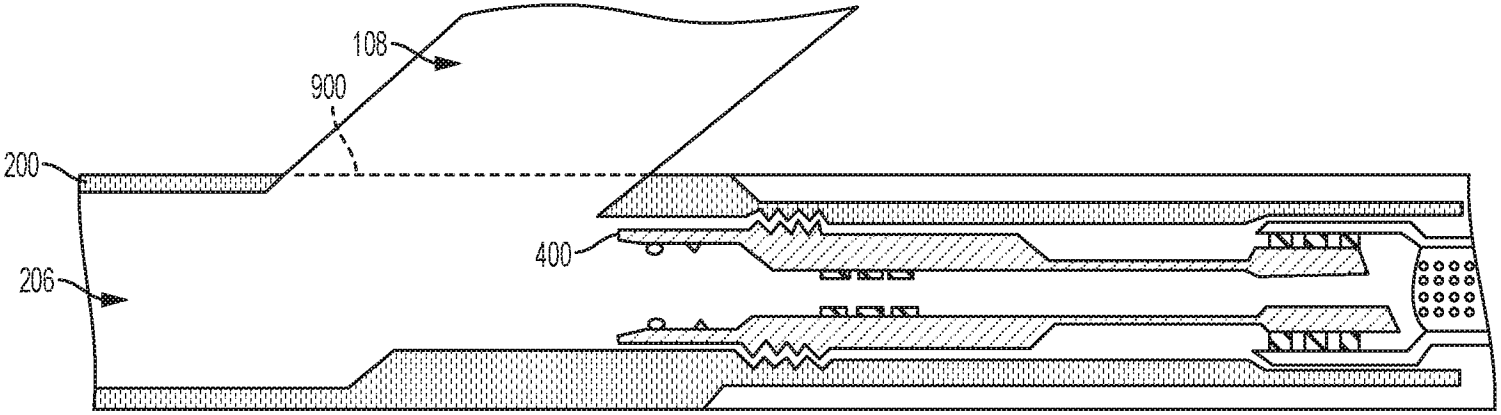
FIG. 10 is a cross-sectional schematic diagram of the wellbore environment of FIG. 1 depicting retrieval of a portion of the whipstock assembly of FIG. 4 from the main borehole according to one aspect of the present disclosure.

In some aspects, the milling device 800 may apply an axial force to the bolt 802 to shear the bolt 802 and decouple the milling device 800 from the whipstock assembly 400. The milling device 800 may engage the angled surface 406 of the whipstock device 402 and be deflected toward a surface of the window sleeve 200. In some aspects, the milling device 800 may engage the window sleeve 200 to mill a window 900, or opening, in the window sleeve 200 as shown in FIG. 9. FIG. 9 is a cross-sectional schematic diagram of the wellbore environment 100 of FIG. 1 depicting the window 900 milled in the window sleeve 200 of FIG. 2 to access the lateral borehole according to one aspect of the present disclosure. In additional and alternative aspects, the milling device 800 may be retrieved from the wellbore 102 and a drilling tool may be routed downhole in the wellbore 102 to drill the lateral borehole 108. Similar to the milling device 800, the drilling tool may engage the angled surface 406 of the whipstock device 402. The angled surface 406 may deflect the drilling tool toward the window 900 in the window sleeve 200 to drill the lateral borehole 108 through the window 900. The whipstock device 402 of the whipstock assembly 400 may be retrieved from the main borehole 106 subsequent to the drilling of the lateral borehole 108. In some aspects, the whipstock device 402 may be detached from the whipstock assembly 400 and retrieved from the main borehole 106 by a retrieval tool using the detaching mechanism 412. The remaining portions of the whipstock assembly 400 may remain fixed in the through-bore 206 of the window sleeve 200 as shown in FIG. 10. FIG. 10 is a cross-sectional schematic diagram of the wellbore environment 100 of FIG. 1 depicting retrieval of a portion of the whipstock assembly 400 of FIG. 4 from the main borehole 106 according to one aspect of the present disclosure. Retrieving the whipstock device 402 from the main borehole 106 may expose the selective-deflection profile 210 of the window sleeve 200 to allow for the junction assembly 600 to interact with the selective-deflection profile 210.

Figure 11:
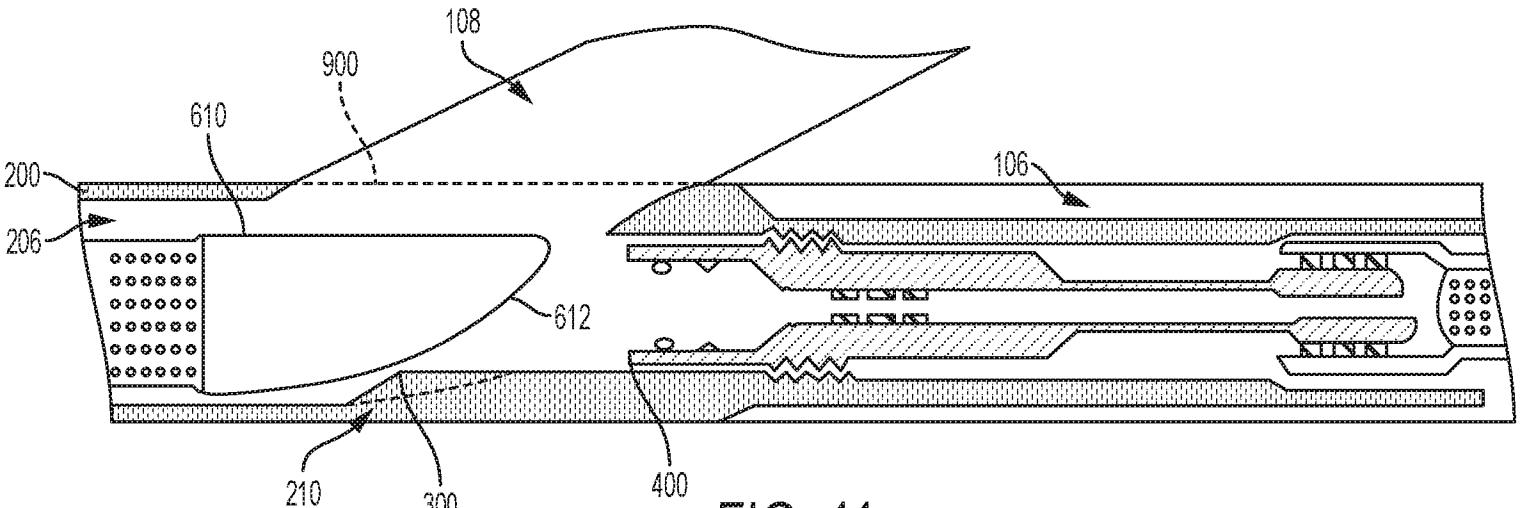
FIG. 11 is a cross-sectional schematic diagram of the wellbore environment of FIG. 1 depicting an installation of the junction assembly of FIG. 6 according to one aspect of the present disclosure.
Figure 12:
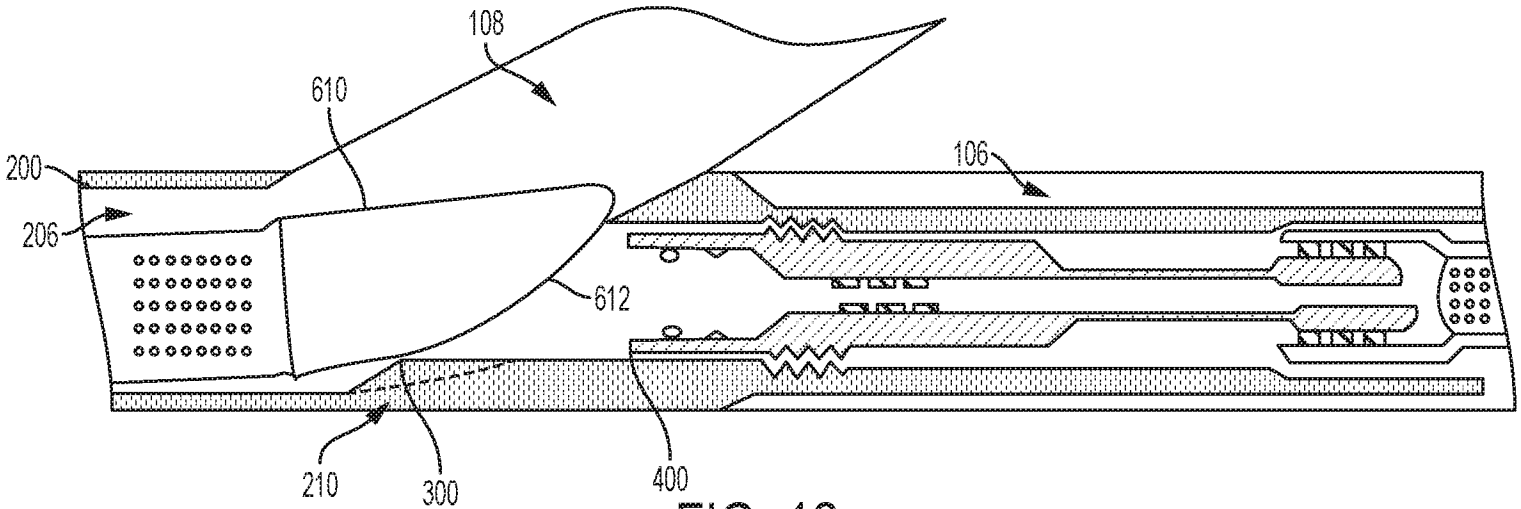
FIG. 12 is a cross-sectional schematic diagram of the wellbore environment of FIG. 1 depicting deflecting a leg of the junction assembly of FIG. 6 by the selective-deflection profile of the window sleeve of FIG. 2 according to one aspect of the present disclosure.
Figure 13:
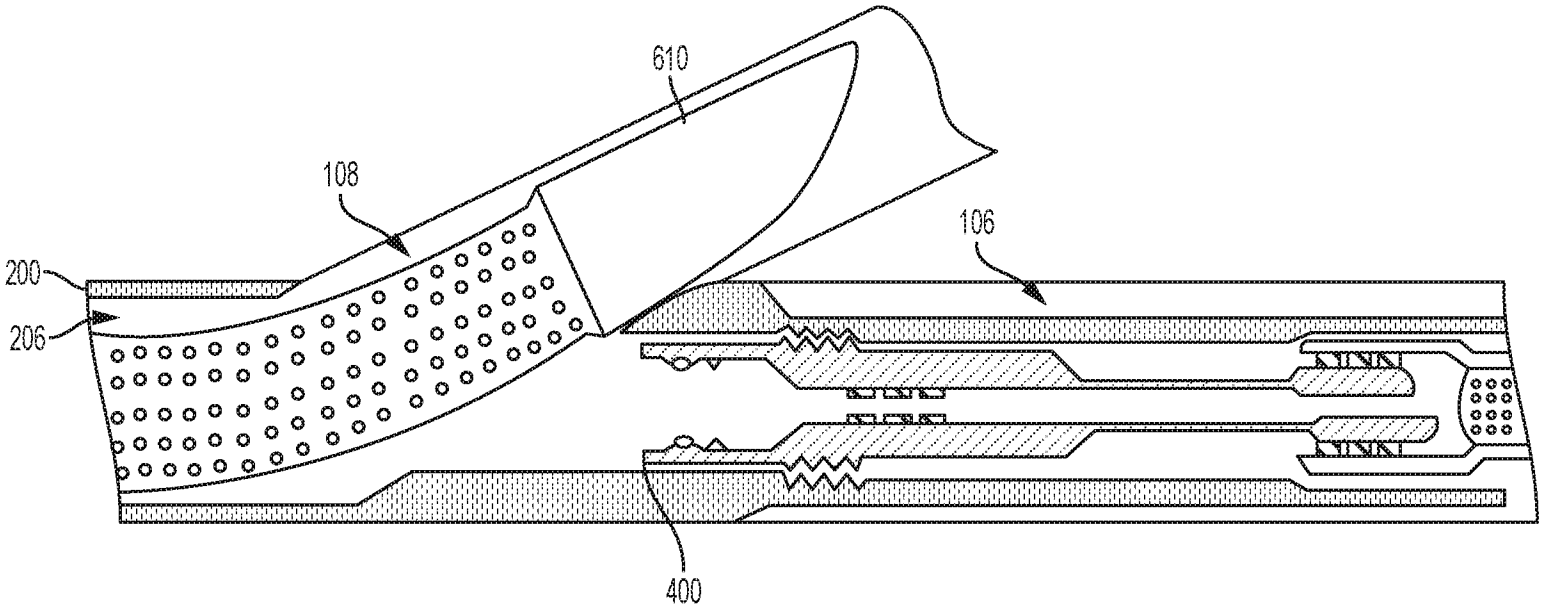
FIG. 13 is a cross-sectional schematic diagram of the wellbore environment of FIG. 1 depicting a trajectory of the junction assembly leg shown in FIG. 12 according to one aspect of the present disclosure.
Figure 14:
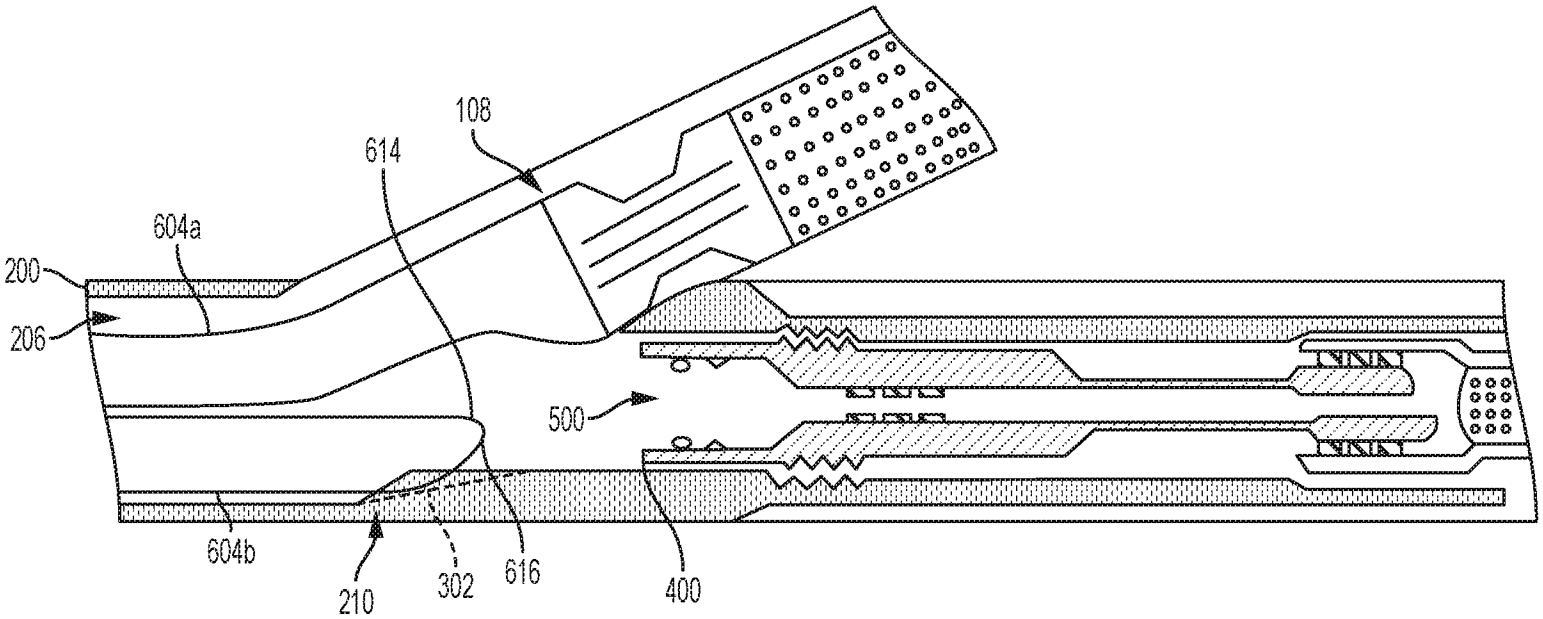
FIG. 14 is a cross-sectional schematic diagram of the wellbore environment of FIG. 1 depicting deflecting another leg of the junction assembly of FIG. 6 by the selective-deflection profile of the window sleeve of FIG. 2 according to one aspect of the present disclosure.

FIG. 11 is a cross-sectional schematic diagram of the wellbore environment 100 of FIG. 1 depicting an installation of the junction assembly 600 of FIG. 6 according to one aspect of the present disclosure. FIG. 11 shows end portion 610 of the junction assembly 600 being routed downhole into the wellbore 102. In some aspects, the end portion 610 may enter the through-bore 206 of the window sleeve 200 and interact with the selective-deflection profile 210 as shown in FIG. 11. The junction assembly 600 may be oriented such that the surface 612 of the end portion 610 interacts with the first incline 300 of the selective-deflection profile 210 to deflect the end portion 610 toward the window 900. FIGS. 12 and 13 show the trajectory of the end portion 610 into the lateral borehole through the window 900 in the window sleeve 200. Specifically, FIG. 12 is a cross-sectional schematic diagram of the wellbore environment 100 of FIG. 1 depicting deflecting the leg 604*a* of the junction assembly 600 of FIG. 6 by the selective-deflection profile 210 of the window sleeve 200 of FIG. 2 according to one aspect of the present disclosure. FIG. 13 is a cross-sectional schematic diagram of the wellbore environment 100 of FIG. 1 depicting the trajectory of the junction assembly leg 604*a* shown in FIG. 12 according to one aspect of the present disclosure. As the junction assembly 600 continues to be routed downhole into the wellbore 102, the leg 604*a* may be flexed such that the end portion 610 continues downhole in the lateral borehole 108 as shown in FIG. 14. FIG. 14 is a cross-sectional schematic diagram of the wellbore environment 100 of FIG. 1 depicting deflecting the other leg 604*b* of the junction assembly 600 of FIG. 6 by the selective-deflection profile 210 of the window sleeve 200 of FIG. 2 according to one aspect of the present disclosure.

The end portion 614 on the downhole end of the leg 604*b* may interact with the selective-deflection profile 210. The surface 616 of the end portion 614 may be oriented to engage the second incline 302. In some aspects, the end portion 614 may be sized to be routed through a passage in the first incline 300 formed by the second incline 302 to avoid engaging the first incline 300. The second incline 302 may deflect the end portion 614 toward the through-bore 500 of the whipstock assembly 400 positioned in the through-bore of the window sleeve 200 downhole of the lateral borehole 108.

Figure 15:
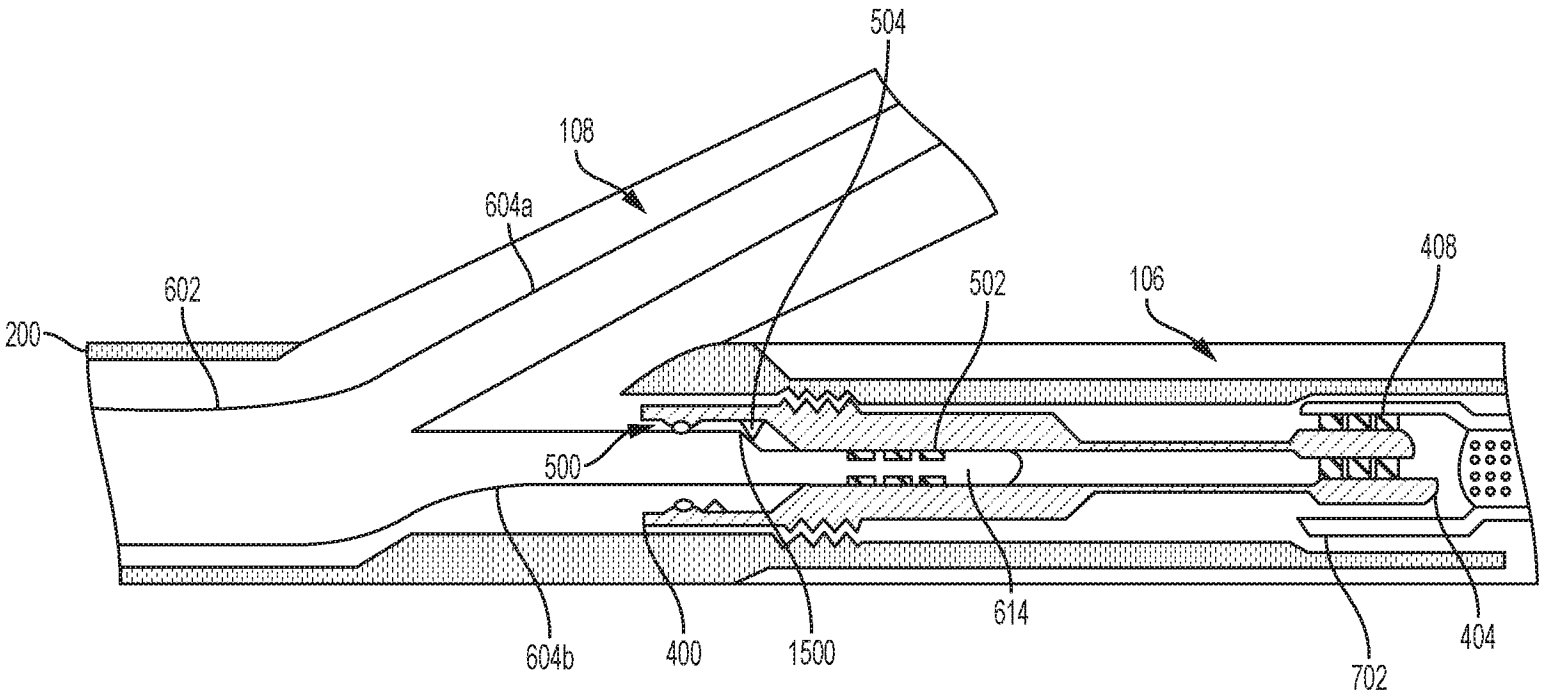
FIG. 15 is a cross-sectional schematic diagram of the wellbore environment of FIG. 1 depicting a completed installation of the junction assembly of FIG. 6 according to one aspect of the present disclosure.

FIG. 15 is a cross-sectional schematic diagram of the wellbore environment 100 of FIG. 1 depicting a completed installation of the junction assembly 600 of FIG. 6 according to one aspect of the present disclosure. FIG. 15 shows the end portion 614 positioned in the through-bore 500 of the whipstock assembly 400. The end portion 614 may engage the isolation devices 502 positioned on an internal surface of the whipstock assembly 400 to, in concert with the isolation devices 408 on the stinger 404 of the whipstock assembly 400, isolate a downhole portion of the main borehole 106 from the lateral borehole 108 and an uphole portion of the main borehole 106. In some aspects, the leg 604*b* may include a shoulder 1500 on an outer surface of the leg 604*b* between the wye block tube 602 and the end portion 614. The shoulder 1500 may be positioned on the leg 604*b* to engage the ring 504 on the internal surface of the whipstock assembly 400 as the end portion 614 is positioned in the through-bore 500 of the whipstock assembly 400. In some aspects, the ring 504 may shear in response to a force applied on the ring 504 by the shoulder 1500 of the leg 604*b*. In additional and alternative aspects, the contact between the ring 504 and the shoulder 1500 may cause a signal to be transmitted through the junction assembly 600 to the surface 104 of the wellbore indicating that the junction assembly 600 is fully installed in the main borehole 106 and the lateral borehole 108.

In some aspects, systems and methods may be provided according to one or more from the following examples:

EXAMPLE #1

A system may include a junction assembly. The junction assembly may include a first leg and a second leg. The first leg may have a first end surface. The second leg may have a second end surface. The system may also include a window sleeve positionable in a borehole of a wellbore. The window sleeve may include a deflection surface. The deflection surface may have a first incline and a second incline. The first incline may correspond to the first end surface to deflect the first leg into a through-bore of a whipstock assembly. The second incline may correspond to the second end surface to deflect the second leg into a lateral borehole of the wellbore.

EXAMPLE #2

The system of Example #1 may feature the first end surface including a first convex surface corresponding to a first angle of the first incline. The second end surface may include a second convex surface corresponding to a second angle of the second incline.

EXAMPLE #3

The system of Examples #1-2 may feature the window sleeve also including a second through-bore sized to receive the whipstock assembly. The window sleeve may also include a latch mechanism positioned on an internal surface of the window sleeve to prevent axial or radial movement of the whipstock assembly in the second through-bore.

EXAMPLE #4

The system of Examples #1-3 may feature the junction assembly also including a liner hanger positionable uphole of the first leg and the second leg to prevent radial or axial movement of the junction assembly in the wellbore.

EXAMPLE #5

The system of Examples #1-4 may feature the junction assembly also including one or more sand screen devices positionable in the lateral borehole proximate to the second end surface.

EXAMPLE #6

The system of Examples #1-5 may feature the junction assembly also including a shoulder positioned on the first leg to engage a shearable ring positioned in the through-bore of the whipstock assembly.

EXAMPLE #7

The system of Examples #1-6 may also include the whipstock assembly. The whipstock assembly may include a retrievable whipstock device having an angled surface to deflect a milling assembly toward a casing of the window sleeve to create a window in the casing.

EXAMPLE #8

The system of Example #7 may feature the whipstock assembly also including a latch mechanism positioned on an external surface of the whipstock assembly to couple the whipstock assembly to the window sleeve. The whipstock assembly may also include a detaching mechanism positioned between the retrievable whipstock device and the latch mechanism to detach the retrievable whipstock device from the whipstock assembly.

EXAMPLE #9

The system of Example #7 may feature the whipstock assembly also including an outer isolation device positionable downhole of the retrievable whipstock device. The whipstock assembly may also include an inner isolation device positionable in the through-bore of the whipstock assembly to engage the first leg of the junction assembly.

EXAMPLE #10

A system may include a window sleeve positionable in a first borehole of a wellbore. The window sleeve may include a deflection mechanism having a first incline and a second incline. The first incline may include a first angle corresponding to a first surface of a first junction assembly leg to deflect the first junction assembly leg into a through-bore of a whipstock assembly. The second incline may include a second angle corresponding to a second surface of a second junction assembly leg to deflect the second junction assembly leg into a second borehole of the wellbore.

EXAMPLE #11

The system of Example #10 may feature a surface of the first incline being positioned in the second incline to create a passage in the second incline that is sized to receive the first junction assembly leg.

EXAMPLE #12

The system of Examples #10-11 may also include a junction assembly. The junction assembly may include the first junction assembly leg and the second junction assembly leg. The first surface may include a first convex shape corresponding to the first angle and the second surface may include a second convex shape corresponding to the second angle.

EXAMPLE #13

The system of Example #12 may feature the junction assembly also including one or more sand screen devices positionable in the second borehole on the second junction assembly leg.

EXAMPLE #14

The system of Examples #10-13 may also include the whipstock assembly. The whipstock assembly may include an outer diameter less than an inner diameter of the window sleeve. The whipstock assembly may include a retrievable whipstock device positionable proximate to the deflection mechanism. The retrievable whipstock device may have an angled surface to deflect a milling tool toward a surface of the window sleeve.

EXAMPLE #15

The system of Example #14 may feature the whipstock assembly also including one or more isolation devices positionable in the first borehole to isolate a portion of the first borehole that is downhole of the whipstock assembly from the second borehole.

EXAMPLE #16

A method may include positioning a deflection profile in a first borehole of a wellbore, the deflection profile including a first incline and a second incline. The method may also include deflecting a first leg of a junction assembly from the first incline toward a through-bore of a whipstock assembly positioned in the first borehole. The method may also include deflecting a second leg of the junction assembly from the second incline toward a second borehole extending from the first borehole.

EXAMPLE #17

The method of Example #16 may feature the deflection profile being positioned on a window sleeve positioned in the first borehole. The method may also feature the whipstock assembly being further positioned internal to the window sleeve. The method may also feature deflecting the second leg of the junction assembly from the second incline toward the second borehole to include deflecting the second leg toward an opening in the window sleeve positioned adjacent to the second borehole.

EXAMPLE #18

The method of Examples #16-17 may also include including coupling the whipstock assembly to a window sleeve positioned in the first borehole to prevent axial or radial movement of the whipstock assembly.

EXAMPLE #19

The method of Example #18 may feature coupling the whipstock assembly to the window sleeve to include engaging a latch mechanism positioned on an external surface of the whipstock assembly with a corresponding latch mechanism positioned on an internal surface of the window sleeve.

EXAMPLE #20

The method of Examples #16-19 may also include isolating a downhole portion of the first borehole from the second borehole by engaging a first isolation device of the whipstock assembly with a liner hanger positioned downhole of the whipstock assembly. The method may also include positioning the first leg of the junction assembly in the through-bore of the whipstock assembly to engage a second isolation device.

The foregoing description of the examples, including illustrated examples, has been presented only for the purpose of illustration and description and is not intended to be exhaustive or to limit the subject matter to the precise forms disclosed. Numerous modifications, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A system, comprising:

a junction assembly including a first leg and a second leg, the first leg having a first end surface, the second leg having a second end surface;

a window sleeve positionable in a borehole of a wellbore and including a deflection surface having a first incline and a second incline, the first incline being inclined to interact with a first radial width of the first end surface to deflect the first leg into a through-bore of a whipstock assembly, the second incline being inclined to interact with a second radial width of the second end surface to deflect the second leg into a lateral borehole of the wellbore, wherein the second radial width is different from the first radial width;

a second through-bore sized to receive the whipstock assembly; and a latch mechanism positioned on an internal surface of the window sleeve to prevent axial or radial movement of the whipstock assembly in the second through-bore.

2. The system of claim 1, wherein the first end surface includes a first convex surface comprising the first radial width to interact with a first angle of the first incline, wherein the second end surface includes a second convex surface comprising the second radial width to interact with a second angle of the second incline.

3. The system of claim 1, wherein the junction assembly further includes a liner hanger positionable uphole of the first leg and the second leg to prevent radial or axial movement of the junction assembly in the wellbore.

4. The system of claim 1, wherein the junction assembly further includes one or more sand screen devices positionable in the lateral borehole proximate to the second end surface.

5. The system of claim 1, wherein the junction assembly further includes a shoulder positioned on the first leg to engage a shearable ring positioned in the through-bore of the whipstock assembly.

6. The system of claim 1, further comprising the whipstock assembly, the whipstock assembly including a retrievable whipstock device having an angled surface to deflect a milling assembly toward a casing of the window sleeve to create a window in the casing.

7. The system of claim 6, wherein the whipstock assembly further includes:

a latch mechanism positioned on an external surface of the whipstock assembly to couple the whipstock assembly to the window sleeve; and a detaching mechanism positioned between the retrievable whipstock device and the latch mechanism to detach the retrievable whipstock device from the whipstock assembly.

8. The system of claim 6, wherein the whipstock assembly further includes:

an outer isolation device positionable downhole of the retrievable whipstock device; and an inner isolation device positionable in the through-bore of the whipstock assembly to engage the first leg of the junction assembly.

9. A system, comprising:

a window sleeve positionable in a first borehole of a wellbore and including a deflection mechanism having a first incline and a second incline, the first incline including a first angle being inclined to interact with a first radial width of a first surface of a first junction assembly leg to deflect the first junction assembly leg into a through-bore of a whipstock assembly, the second incline including a second angle being inclined to interact with a second radial width of a second surface of a second junction assembly leg to deflect the second junction assembly leg into a second borehole of the wellbore, wherein the second radial width is different from the first radial width; and the whipstock assembly having an outer diameter less than an inner diameter of the window sleeve, wherein the whipstock assembly includes a retrievable whipstock device positionable proximate to the deflection mechanism and having an angled surface to deflect a milling tool toward a surface of the window sleeve.

10. The system of claim 9, wherein a surface of the first incline is positioned in the second incline to create a passage in the second incline that is sized to receive the first junction assembly leg.

11. The system of claim 9, further comprising a junction assembly including the first junction assembly leg and the second junction assembly leg, wherein the first surface includes a first convex shape comprising the first radial width to interact with the first angle and the second surface includes a second convex shape comprising the second radial width to interact with the second angle.

12. The system of claim 11, wherein the junction assembly further includes one or more sand screen devices positionable in the second borehole on the second junction assembly leg.

13. The system of claim 9, wherein the whipstock assembly further includes one or more isolation devices positionable in the first borehole to isolate a portion of the first borehole that is downhole of the whipstock assembly from the second borehole.

14. A method comprising:

positioning a deflection profile on a window sleeve positioned in a first borehole of a wellbore, the deflection profile including a first incline and a second incline;

deflecting a first leg of a junction assembly from the first incline toward a through-bore of a whipstock assembly positioned internal to the window sleeve in the first borehole, wherein the first incline is inclined to interact with a first radial width of the first leg; and deflecting a second leg of the junction assembly from the second incline toward an opening in the window sleeve positioned adjacent to a second borehole extending from the first borehole, wherein the second incline is inclined to interact with a second radial width of the second leg that is different from the first radial width.

15. The method of claim 14, further including coupling the whipstock assembly to the window sleeve positioned in the first borehole to prevent axial or radial movement of the whipstock assembly.

16. The method of claim 15, wherein coupling the whipstock assembly to the window sleeve includes engaging a latch mechanism positioned on an external surface of the whipstock assembly with a corresponding latch mechanism positioned on an internal surface of the window sleeve.

17. The method of claim 14, further including isolating a downhole portion of the first borehole from the second borehole by:

engaging a first isolation device of the whipstock assembly with a liner hanger positioned downhole of the whipstock assembly; and positioning the first leg of the junction assembly in the through-bore of the whipstock assembly to engage a second isolation device.

* * * * *